US007479053B2

(12) United States Patent
Wu

(10) Patent No.: US 7,479,053 B2
(45) Date of Patent: Jan. 20, 2009

(54) INFLATABLE BAG WITH PATTERN PRINTED ACCORDING TO PERSONAL PREFERRED DESIGN

(76) Inventor: Teng-Hui Wu, No. 46-2, Lane 42, Jhongnan St., Nangang District, Taipei City (TW)

( * ) Notice: Subject to any disclaimer, the term of this patent is extended or adjusted under 35 U.S.C. 154(b) by 421 days.

(21) Appl. No.: 11/282,571

(22) Filed: Nov. 21, 2005

(65) Prior Publication Data

US 2007/0117493 A1 May 24, 2007

(51) Int. Cl.
*A63H 27/10* (2006.01)

(52) U.S. Cl. ..... 446/220

(58) Field of Classification Search ..... 446/220; 383/3, 109

See application file for complete search history.

(56) References Cited

U.S. PATENT DOCUMENTS

| | | | | |
|---|---|---|---|---|
| 5,951,359 | A * | 9/1999 | Prakopcyk et al. | 446/220 |
| 6,435,935 | B1 * | 8/2002 | Komaba | 446/220 |
| 6,663,455 | B1 * | 12/2003 | Lang | 446/71 |
| 7,335,083 | B2 * | 2/2008 | Hwang | 446/220 |
| 2003/0035909 | A1 * | 2/2003 | Liau | 428/35.4 |

* cited by examiner

*Primary Examiner*—John Ricci
(74) *Attorney, Agent, or Firm*—Bacon & Thomas, PLLC

(57) ABSTRACT

The present invention is to provide an inflatable bag with pattern printed according to personal preferred design comprising a bag member having a dye adhering layer formed on a surface thereof. The bag member is adapted to place on a paper tray of a compact graphics output device. The graphics output device is then activated to cause the dye adhering layer to absorb different dyes in an area circumscribed by an outline of a pattern designed in advance by software. The dyes are adhered to the dye adhering layer when the dyes are completely absorbed by the dye adhering layer. The pattern designed according to personal preference is thus printed.

7 Claims, 3 Drawing Sheets

INFLATABLE BAG WITH PATTERN PRINTED ACCORDING TO PERSONAL PREFERRED DESIGN

FIELD OF THE INVENTION

The present invention relates to bags and more particularly to an inflatable bag with a pattern printed according to personal preferred design.

BACKGROUND OF THE INVENTION

A conventional bag inflated with air is shown in FIGS. 1 and 2. The inflatable bag comprises a bag member 1 including two PE (polyethylene) films 10 and two nylon films 12 each formed on the PE film 10. For making the surface of the bag member 1 glossy, some manufacturers of the art may plate an aluminum layer 14 on an inner surface of each nylon film 12 (i.e., the surface facing the PE film 10). Next, press the nylon films 12 having plated aluminum layers 14 onto the PE films 10 to finish the inflatable bag. As an end, the surface of the bag member 1 looks glossy.

For facilitating air inflation, it is typical of providing an air valve 2 in the PE films 10 in which a portion of the air valve 2 is concealed in the PE films 10 and a remaining portion thereof is projected from the PE films 10. For forming the bag member 1, outer surfaces of the PE films 10, an outer surface of the air valve 2, and corresponding inner surfaces of the PE films 10 are subjected to heat for sealing. At the same time, a flat channel 20 is formed in the air valve 2. Also, ink 20 is coated on engaged inner surfaces of the channel 20.

For inflating the inflatable bag, a user has to insert one end of an elongate charging tube (not shown) through the air valve 2 into the bag member 1. Next, the user may blow the other end of the charging tube for inflating the bag member 1 or an air compressor is employed to blow same. The user may pull the charging tube out of the air valve 2 after inflating the inflatable bag. At this time, air pressure in the bag member 1 is higher than the atmospheric pressure and thus may tightly compress the flat channel 20 in the bag member 1 for sealing. At the same time, ink 22 coated on inner surfaces of the channel 20 is mixed to prevent air from leaking. Next, the user may tie a projected portion of the air valve 2 around a support of a post such that the bag member 1 may be affixed to the support for exhibition.

However, a pattern 18 on the bag member 1 is formed by printing on the surface thereof by the manufacturer in advance because the surface of the bag member 1 is formed of nylon film 12. A customer has to select an inflatable bag having a preferred pattern 18 printed thereon or an appropriate one from a number of inflatable bags with different patterns 18 produced by the manufacturer in advance. Thus, the number of inflatable bags, which can be selected by a customer, is limitedly provided by the manufacturer. In another case some customers may select to give up buying the inflatable bag(s) because no inflatable bag has preferred pattern, resulting in a sales loss of inflatable bag vendor. Moreover, most patterns printed on the inflatable bags are dull without inventive concept and they are misaligned with the trend of emphasizing personal preference and novelty. Thus, it is desirable to provide a novel inflatable bag having a pattern printed according to personal preferred design rather than produced by the manufacturer in advance in order to overcome the inadequacy of the prior art.

SUMMARY OF THE INVENTION

After considerable research and experimentation, an inflatable bag with pattern printed according to personal preferred design according to the present invention has been devised so as to overcome the above drawback of the prior art.

It is an object of the present invention to provide an inflatable bag with pattern printed according to personal preferred design comprising a bag member having a dye adhering layer formed on a surface thereof. The bag member is adapted to place on a paper tray of a compact graphics output device. The graphics output device is then activated to cause the dye adhering layer to absorb different dyes in an area circumscribed by an outline of a pattern designed in advance by software. The dyes are adhered to the dye adhering layer when the dyes are completely absorbed by the dye adhering layer. The pattern designed according to personal preference is thus printed. By utilizing this inflatable bag, the present invention eliminates the drawback of a pattern only formed on a well-known inflatable bag by the manufacturer in advance.

In one aspect of the present invention the bag member further comprises a tear-off portion circumscribing a sealing portion, a printing sheet comprised of the bag member and the tear-off portion, and a tear-off line on the printing sheets formed around the sealing portion and the air valve, and wherein the dye adhering layer is formed on an area encircled by the sealing portion, the printing sheet has the size of A4 acceptable by the graphics output device such that a user may run software installed in a personal computer electrically connected to the graphics output device to design a pattern according to personal preference, the graphics output device may then activate print a pattern on the printing sheet, and the tear-off portion is adapted to tear off along the tear-off line to form a bag member having the pattern printed according to personal preferred design.

In another aspect of the present invention there is further provided a padding sheet formed on at least one surface of the printing sheet. At least one portion of an inner edge of the padding sheet is releasably connected to the bag member or the tear-off portion. Strength of the printing sheet is thus enhanced by the padding sheet such that it is possible of preventing the bag member from being torn, broken, or bent during the process of being printed by the graphics output device.

The above and other objects, features and advantages of the present invention will become apparent from the following detailed description taken with the accompanying drawings.

DETAILED DESCRIPTION OF THE PREFERRED EMBODIMENTS

Figure 1:
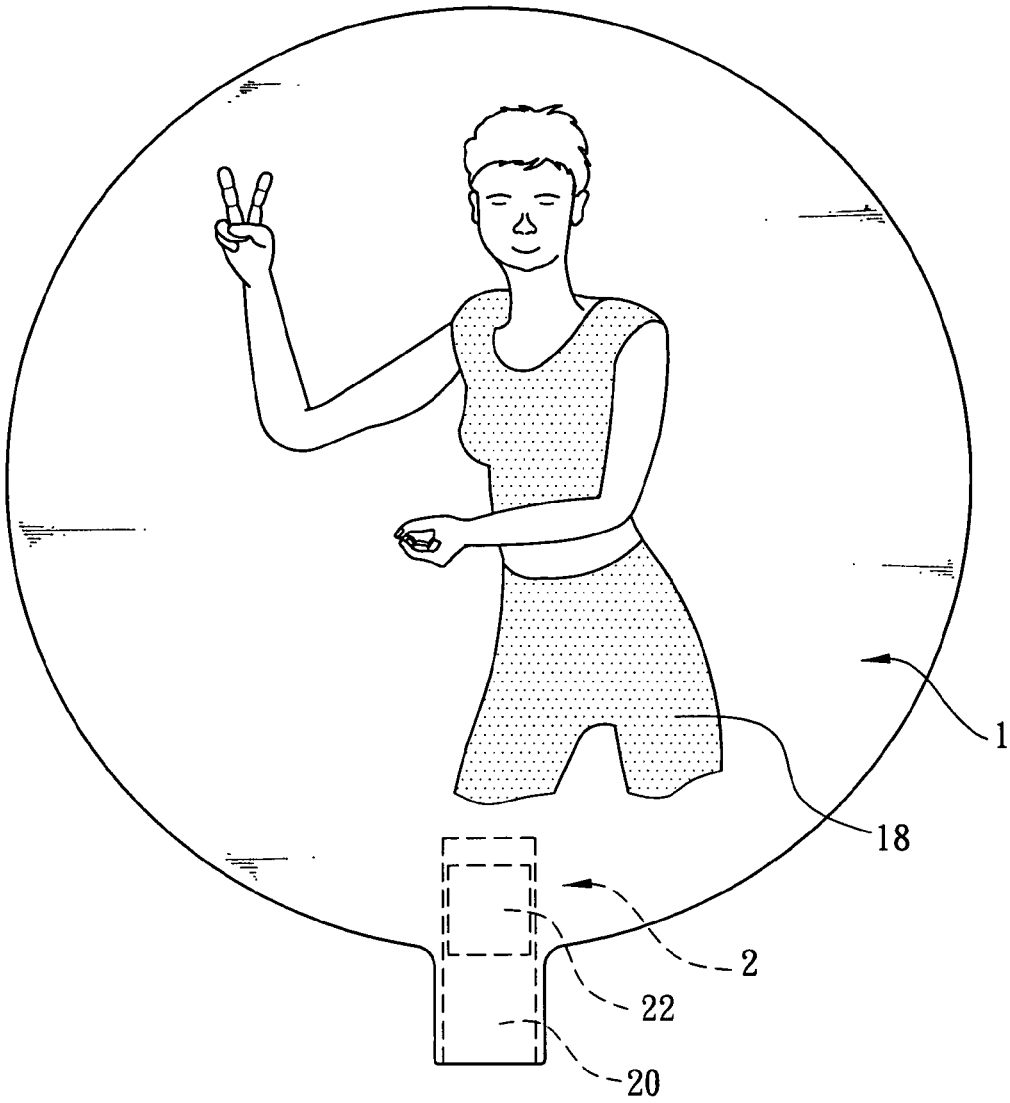
FIG. 1 (Prior Art)
FIG. 1 is a side view of a conventional inflatable bag having a pattern printed by the manufacturer in advance.
Figure 2:
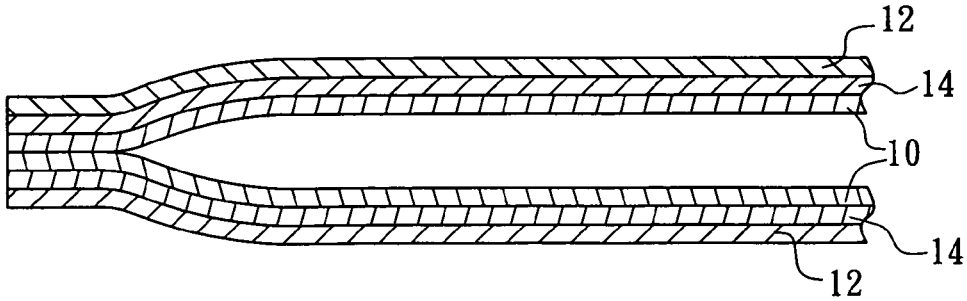
FIG. 2 (Prior Art)
FIG. 2 is a sectional view of the inflatable bag in FIG. 1.
Figure 3:
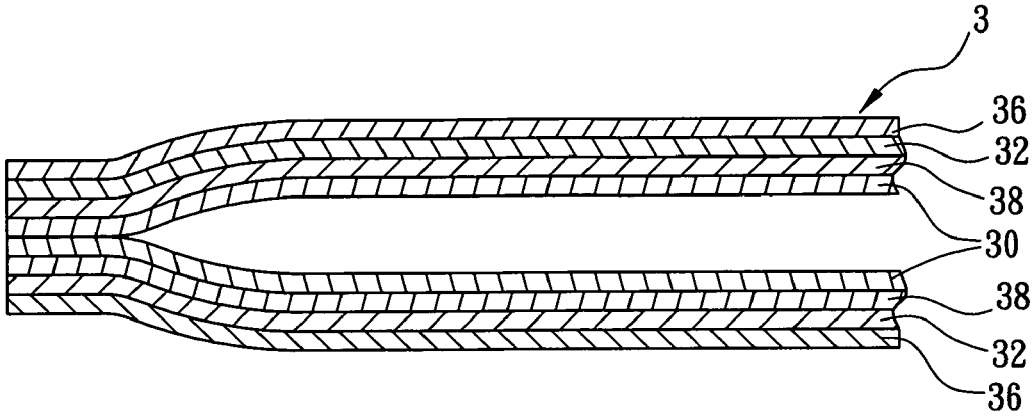
FIG. 3 is a sectional view of an inflatable bag according to a preferred embodiment of the invention.
Figure 4:
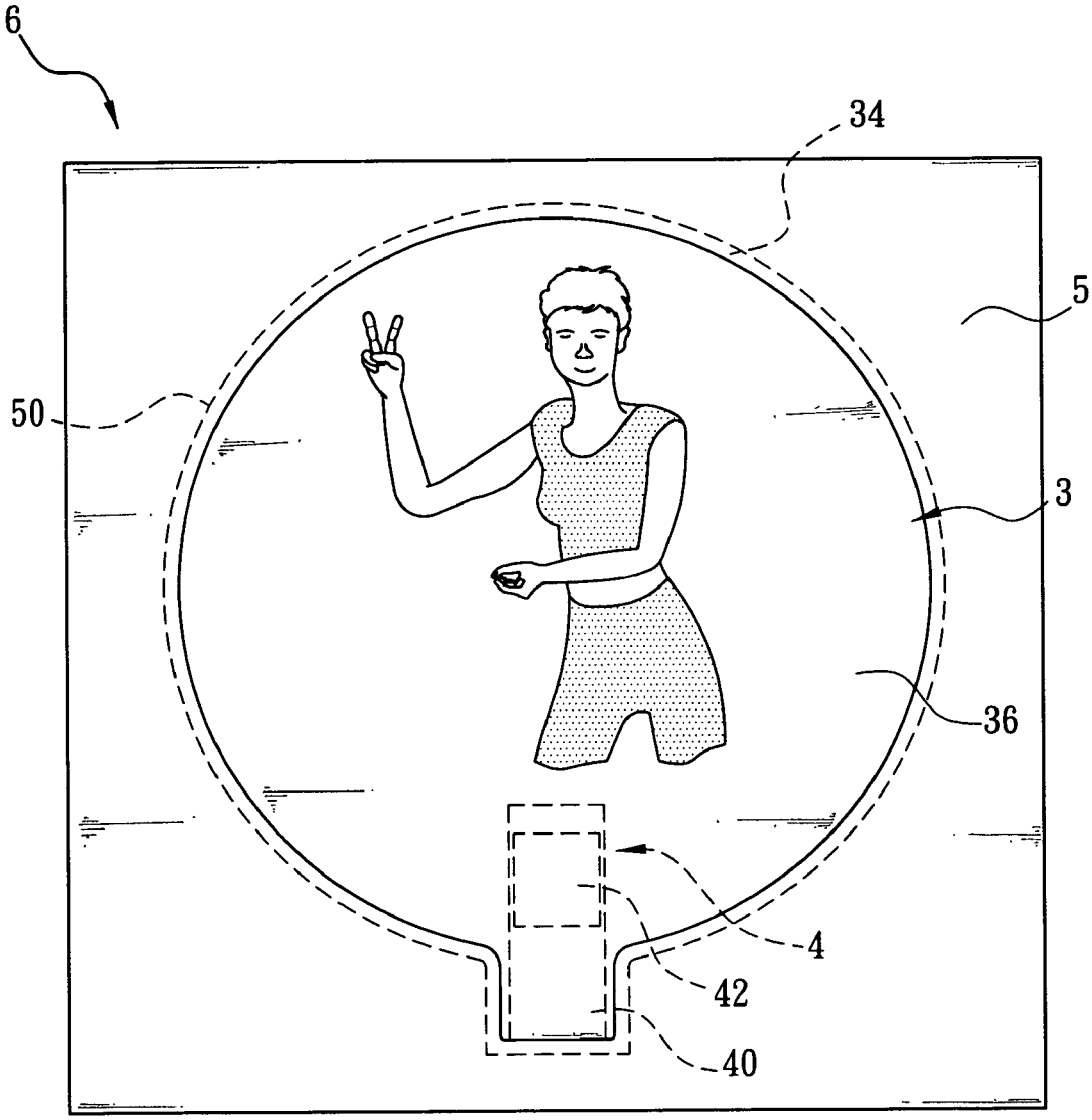
FIG. 4 is a plan view of a printing sheet according to the invention.

Referring to FIGS. 3 and 4, an inflatable bag with pattern printed according to personal preferred design in accordance with a preferred embodiment of the invention comprises a bag member 3 including two adhering films 30 and two covering films 32 each formed on a surface of the adhering film 30. The bag member 3 further comprises a continuous sealing portion 34. An air valve 4 is provided at an edge of the sealing portion 34. The air valve 4 has a portion concealed in the adhering films 30 and a remaining portion projected from the adhering films 30. A flat channel 40 is formed in the air valve 4. Ink 20 is coated on engaged inner surfaces of the channel 40. A dye adhering layer 36 is formed on a surface of each covering film 32. The dye adhering layer 36 is adapted to absorb dye applied thereonto and adhere to the same. As such, the bag member 3 can be placed on a sheet feeder (or paper tray) of a compact graphics output device (e.g., printer, copy machine, or plotter). Next, the graphics output device is activated to cause the dye adhering layer 36 to absorb different dyes in an area circumscribed by an outline of a pattern designed in advance by software. The dyes are adhered to the dye adhering layer 36 when the dyes are completely absorbed by the dye adhering layer 36. A pattern designed according to personal preference is thus printed. The drawback of a pattern only formed on a well-known inflatable bag by the manufacturer in advance is thus eliminated.

Referring to FIGS. 3 and 4 again, in a preferred embodiment of the invention the bag member 3 further comprises a tear-off portion 5 circumscribing the sealing portion 34. A printing sheet 6 is comprised of the bag member 3 and the tear-off portion 5. On the printing sheet 6 there is provided a tear-off line 50 around the sealing portion 34 and the air valve 4. The dye adhering layer 36 is formed on an area encircled by the sealing portion 34. Preferably, the printing sheet 6 has the size of A4 (i.e., the standard size of typing paper) acceptable by the graphics output device. Thus, a user may run software installed in a personal computer electrically connected to the graphics output device to design a pattern according to personal preference or one appropriate for a specific place. Next, the graphics output device may activate to adhere different dyes to the dye adhering layer 36 based on signals of the pattern transmitted from the computer (i.e., printing pattern). Finally, tear off the tear-off portion 5 along the tear-off line 50 to form a bag member 3 having a pattern printed according to personal preferred design.

Figure 5:
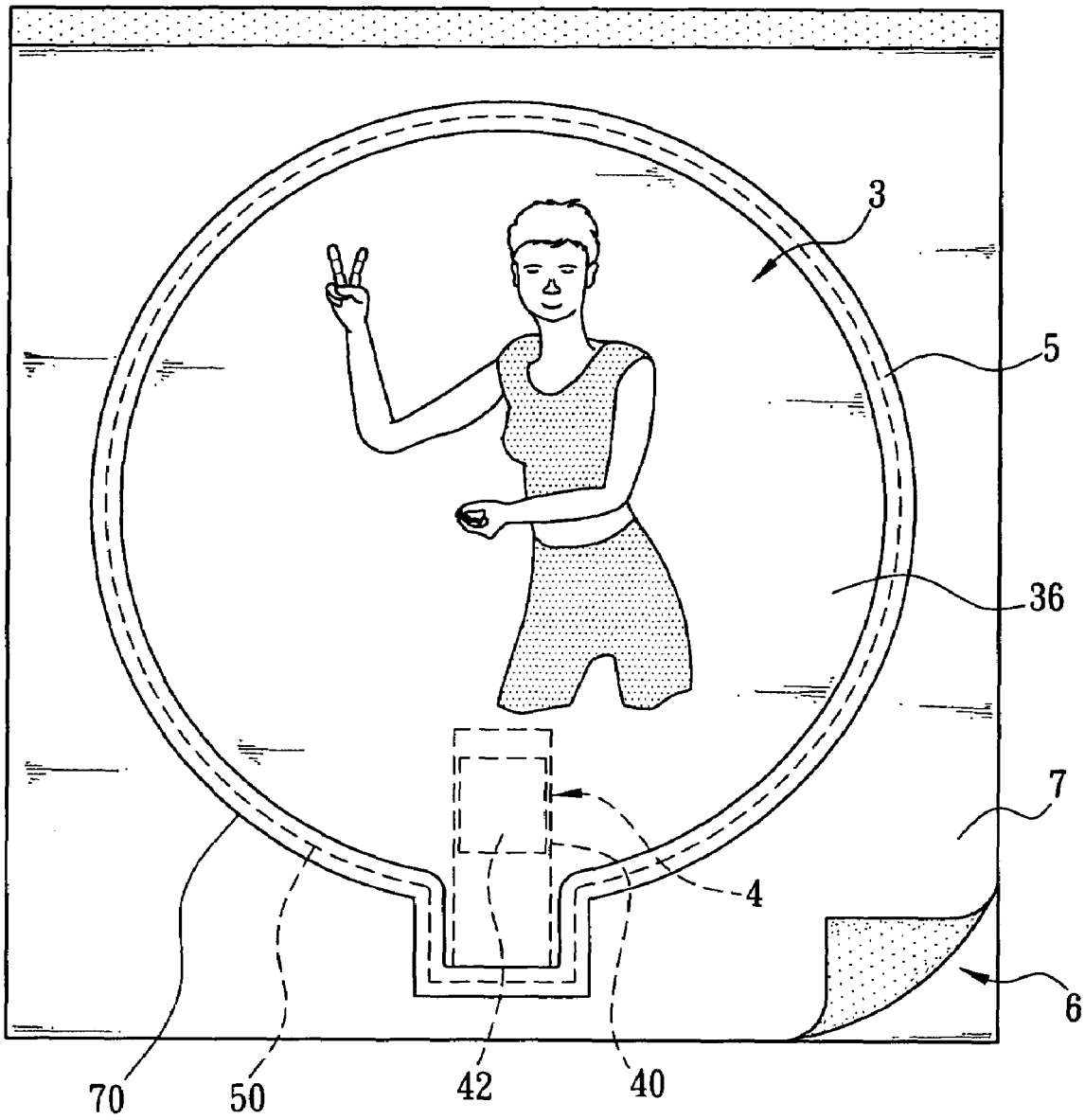
FIG. 5 is a plan view of a padding sheet and the adhered printing sheet according to the invention.

Referring to FIG. 5, in the preferred embodiment a padding sheet 7 is formed on at least one surface of the printing sheet 6. At least one portion of an inner edge of the padding sheet 7 is releasably connected to the bag member 3 or the tear-off portion 5. Strength of the printing sheet 6 can be enhanced by the padding sheet 7 such that it is possible of preventing the bag member 3 from being torn, broken, or bent during the process of being printed by the graphics output device. As a result, the pattern can be successfully printed on the bag member 3 by the graphics output device. For printing the pattern on an area of the bag member 3 covered by the padding sheet 7, a circular opening 70 facing an area with the tear-off line 50 circumscribed therein is formed in the padding sheet 7. As such, the pattern still can be printed on either surface of the bag member 3 by the graphics output device irrespective of whether one surface of the bag member 3 is covered by the padding sheet 7 or both surfaces of the bag member 3 are covered by the padding sheet 7.

Referring to FIG. 3 again in the preferred embodiment the covering film 32 is transparent. A coating 38 for reflecting light or a glossy coating 38 is formed between the adhering film 30 and the covering film 32 at the same surface of the bag member 3. External light illuminated on the bag member 3 is adapted to pass the transparent covering film 32 prior to being reflected by the coating 38 or the glossy coating 38 can be seen through the covering film 32 for vividly showing the surface of the bag member 3.

In the invention the adhering film 30 is a PE film. The covering film 32 is a nylon film. The coating 38 is an aluminum coating. The dye adhering layer 36 is comprised of an adhesive and an absorbing material. The adhesive and the absorbing material are mixed such that the adhesive is introduced into the absorbing material. Thus, the adhesive is adapted to apply on the surface of the bag member 3 and adhere thereto. As a result, the absorbing material is adapted to absorb watery or oily solvent of the dye printed on the surface of the bag member 3 with the dye adhered to the dye adhering layer 36. In the invention, the adhesive is PVA (polyvinyl alcohol) and the absorbing material is $CaCO_3$.

By configuring as above, a user may first design a pattern and store same in a file by running software installed in a computer. Next, the user may place the bag member 3 in the graphics output device. The graphics output device then may process the pattern transmitted from the file in the computer. Next, dye in the graphics output device may adhere to the surface of the bag member 3 prior to printing same thereon. As an end, the purpose of enabling a user to design a pattern according to his/her personal preference and print same on the surface of the bag member 3 is obtained. As to inflating the bag member 3, its technique is the same as the prior bag inflation technique. Accordingly, further description is omitted for purposes of brevity and convenience only.

While the invention herein disclosed has been described by means of specific embodiments, numerous modifications and variations could be made thereto by those skilled in the art without departing from the scope and spirit of the invention set forth in the claims.

What is claimed is:

1. An inflatable bag for being printed with a pattern comprising:

two adhering films;

a continuous sealing portion formed on an inner surface of each of the adhering films for joining the adhering films together;

two covering films each respectively formed on an outer surface of the adhering films;

an air valve formed at an edge of the sealing portion, the air valve having a portion concealed in the adhering films and a remaining portion projected from the adhering films;

a flat channel formed in the air valve;

ink coated on inner surfaces of the channel;

a tear-off portion circumscribing the sealing portion and the air valve;

a dye adhering layer formed on a surface of each of the covering films at an area circumscribed by the sealing portion, wherein the dye adhering layer is adapted to absorb dye applied thereonto; and a padding sheet formed on at least one surface of the tear-off portion, wherein at least one portion of an inner surface of the padding sheet is releasably connected to the tear-off portion.

2. The inflatable bag of claim 1, wherein at least one covering film is transparent, the inflatable bag further comprising a coating for reflecting light formed between the respective adhering film and the at least one covering film.

3. The inflatable bag of claim 1, wherein at least one covering film is transparent, the inflatable bag further comprising a glossy coating formed between the respective adhering film and the at least one covering film.

4. The inflatable bag of claim 1, wherein at least one adhering film is a PE (polyethylene) film.

5. The inflatable bag of claim 1, wherein at least one covering film is a nylon film.

6. The inflatable bag of claim 1, wherein at least one dye adhering layer is comprised of an adhesive and an absorbing material, the adhesive and the absorbing material being mixed such that the adhesive is introduced into the absorbing material, the adhesive is adapted to apply on the surface of the respective covering film and adhere thereto, and the absorbing material is adapted to absorb watery or oily solvent of the dye printed on the surface of the at least one dye adhering layer.

7. The inflatable bag of claim 1, wherein the padding sheet comprises an opening facing an area with the sealing portion circumscribed therein.

* * * * *